US009523339B2

(12) United States Patent
Fujita et al.

(10) Patent No.: US 9,523,339 B2
(45) Date of Patent: Dec. 20, 2016

(54) ENGINE STARTING APPARATUS

(71) Applicant: DENSO CORPORATION, Kariya, Aichi-pref. (JP)

(72) Inventors: Tatsuya Fujita, Obu (JP); Mitsuhiro Murata, Niwa-gun (JP)

(73) Assignee: DENSO CORPORATION, Kariya (JP)

( * ) Notice: Subject to any disclaimer, the term of this patent is extended or adjusted under 35 U.S.C. 154(b) by 181 days.

(21) Appl. No.: 14/575,320

(22) Filed: Dec. 18, 2014

(65) Prior Publication Data

US 2015/0167613 A1 Jun. 18, 2015

(30) Foreign Application Priority Data

Dec. 18, 2013 (JP) ..... 2013-261092
Mar. 12, 2014 (JP) ..... 2014-048604

(51) Int. Cl.
*F02N 11/08* (2006.01)

(52) U.S. Cl.
CPC ..... *F02N 11/0851* (2013.01); *F02N 11/0848* (2013.01); *F02N 11/0859* (2013.01); *F02N 11/0822* (2013.01); *F02N 2200/022* (2013.01); *F02N 2200/043* (2013.01); *F02N 2200/061* (2013.01); *F02N 2200/102* (2013.01); *F02N 2200/14* (2013.01)

(58) Field of Classification Search
CPC ..... F02N 11/0851; F02N 11/0859; F02N 11/0848; F02N 11/0822; F02N 2200/043; F02N 2200/14; F02N 2200/102; F02N 2200/022; F02N 2200/061
USPC ..... 123/179.28, 179.4, 179.25
See application file for complete search history.

(56) References Cited

U.S. PATENT DOCUMENTS 6,481,404 B1 * 11/2002 Perry ..... F02D 41/3082 123/179.3
7,677,123 B2 * 3/2010 Nawa ..... F02N 15/046 192/56.61
2015/0260141 A1 * 9/2015 Fujita ..... F02N 11/105 290/38 C

FOREIGN PATENT DOCUMENTS

JP H07-29237 Y2 7/1995
JP 2002-188549 A 7/2002

* cited by examiner

*Primary Examiner* — Hai Huynh
(74) *Attorney, Agent, or Firm* — Oliff PLC

(57) ABSTRACT

An engine starting apparatus includes a starter and a starter control unit configured to control driving of the starter. The starter control unit operates a motor with a pinion engaged with a ring gear to thereby crank an engine, and de-engage the pinion from the ring gear or de-energize the motor to thereby terminate the cranking of the engine. A cranking time from when cranking of the engine is initiated to when a predetermined engine speed equal to or greater than 450 rpm is reached is equal to or less than an acceptable limit of cranking time that does not provide, to a user of a vehicle, noticeable discomfort caused by cranking noise generated during the cranking of the engine.

13 Claims, 12 Drawing Sheets

ENGINE STARTING APPARATUS

CROSS-REFERENCE TO RELATED APPLICATION

This application is based on and claims the benefit of priority from earlier Japanese Patent Applications No. 2013-261092 filed Dec. 18, 2013 and No. 2014-48604 filed Mar. 12, 2014, the descriptions of which are incorporated herein by reference.

BACKGROUND

Technical Field

The present invention relates to an engine starting apparatus.

Related Art

A typical engine starting method includes using an inertia-engagement-type starter to turn an engine at a low engine speed (of 400 rpm or less) and then igniting or injecting fuel into a combustion chamber, thereby increasing an engine speed to an idle speed only through combustion in the combustion chamber.

However, since such a method increases the engine speed from a low engine speed range to the idle speed with combustion alone, an amount of fuel to be injected when starting the engine has to be increased, resulting in deterioration of fuel economy.

FIG. 12 shows a relationship Z of an engine speed and a fuel injection quantity of a gasoline engine with a fixed accelerator position. A required fuel injection quantity at and near the idle speed Na of the engine is specified by the relationship Z while, below the predetermined engine speed Nmin (about 450 rpm), the required fuel injection quantity non-linearly increases away from the relationship Z as the engine speed is decreased. That is, below the predetermined engine speed Nmin, a fuel injection quantity increased above an injection quantity specified by the relationship Z (referred to as an increased injection quantity) is required.

A range of engine speeds less than the predetermined engine speed Nmin is referred to as a range I. A range of engine speeds equal to or greater than the predetermined engine speed Nmin is referred to as a range II, where the engine speed can be maintained without increasing the injection quantity.

A conventional method for starting the engine with the inertia-engagement-type starter requires, to turn the engine at an engine speed in the range I, the injection quantity to be increased above the injection quantity specified by the relationship Z, which may diminish the fuel economy.

Therefore there is a need for a technique for starting the engine, which increases the engine speed to approximately the idle speed Na prior to fuel injection so that increasing the injection quantity is not required when starting the engine, thereby improving the fuel economy.

Such a technique for starting the engine may employ an electrical motor and generator referred to as an integrated starter and generator (ISG), or a motor generator (MG).

However, the ISG and the MG suffer from expensiveness. In addition, since they are alternators, start-up performance is poor relative to the inertia-engagement-type starter incorporating therein a direct-current (DC) motor.

It would therefore be desirable to have a technique for starting the engine that increases the engine speed to approximately the idle speed Na prior to the fuel injection with an inexpensive inertia-engagement-type starter having good start-up performance. However, the inertia-engagement-type starter produces large cranking noise. Conventionally, it is therefore necessary to undergo combustion before the engine speed reaches the range II as above and terminate driving the starter.

Without eliminating or reducing the discomfort caused by the cranking noise, it is impossible to have a technique for starting the engine with the inertia-engagement-type starter, which has improved fuel economy.

Japanese Patent Application Laid-Open Publication No. 2002-188549 discloses a technique for starting the engine by increasing the engine speed up to the idle speed with the inertia-engagement-type starter. However, no cranking noise is taken into account. In addition, in the technique disclosed in Japanese Patent Application Laid-Open Publication No. 2002-188549 and the conventional technique for starting the engine that increases the engine speed within a low engine speed range, a one-way clutch isolates transfer of torque of a starter motor to the engine at the same as or after the ignition in the combustion chamber. That is, cranking the engine is terminated at the same time as or after the ignition in the combustion chamber.

In consideration of the foregoing, exemplary embodiments of the present invention are directed to providing an engine starting apparatus capable of starting an engine via an inexpensive inertia-engagement-type starter while improving fuel economy.

SUMMARY

In accordance with an exemplary embodiment of the present invention, there is provided an engine starting apparatus including a starter and a starter control unit configured to control driving of the starter.

The starter includes a motor that generates rotational force, a pinion that receives the rotational force of the motor to rotate, a motor energization unit that turns on and off power supply from a battery to the motor, and a pinion pushing unit that pushes the pinion toward a ring gear of an engine to mesh with the ring gear.

The starter control unit is configured to operate the motor with the pinion engaged with the ring gear to thereby crank the engine, and de-engage the pinion from the ring gear or de-energize the motor to thereby terminate the cranking of the engine.

A cranking time from when cranking of the engine is initiated to when a predetermined engine speed equal to or greater than 450 rpm is reached is equal to or less than an acceptable limit of cranking time that does not provide noticeable discomfort to a user of a vehicle.

The inventors have found that discomfort caused by cranking noise depends on a duration of cranking noise (i.e., a cranking time), rather than a magnitude of cranking noise. For an increased predetermined engine speed, a reduced cranking time can mitigate discomfort caused by cranking noise.

In the above apparatus, the engine speed is increased to within a high speed range of engine speeds equal to or greater than 450 rpm within a cranking time short enough to provide unnoticeable discomfort to the user (or occupants) of the vehicle.

This can reduce the discomfort caused by the cranking noise that occurs during cranking of the engine for increasing the engine speed to within the high speed range of engine speeds equal to or greater than 450 rpm.

That is, the engine speed can be increased to within the high speed range of engine speeds equal to or greater than 450 rpm not by combustion, but by the starter, while mitigating the discomfort caused by the cranking noise. Thus, an engine starting apparatus can be provided that is capable of starting an engine via an inexpensive inertia-engagement-type starter while improving fuel economy.

DESCRIPTION OF SPECIFIC EMBODIMENTS

Figure 1:
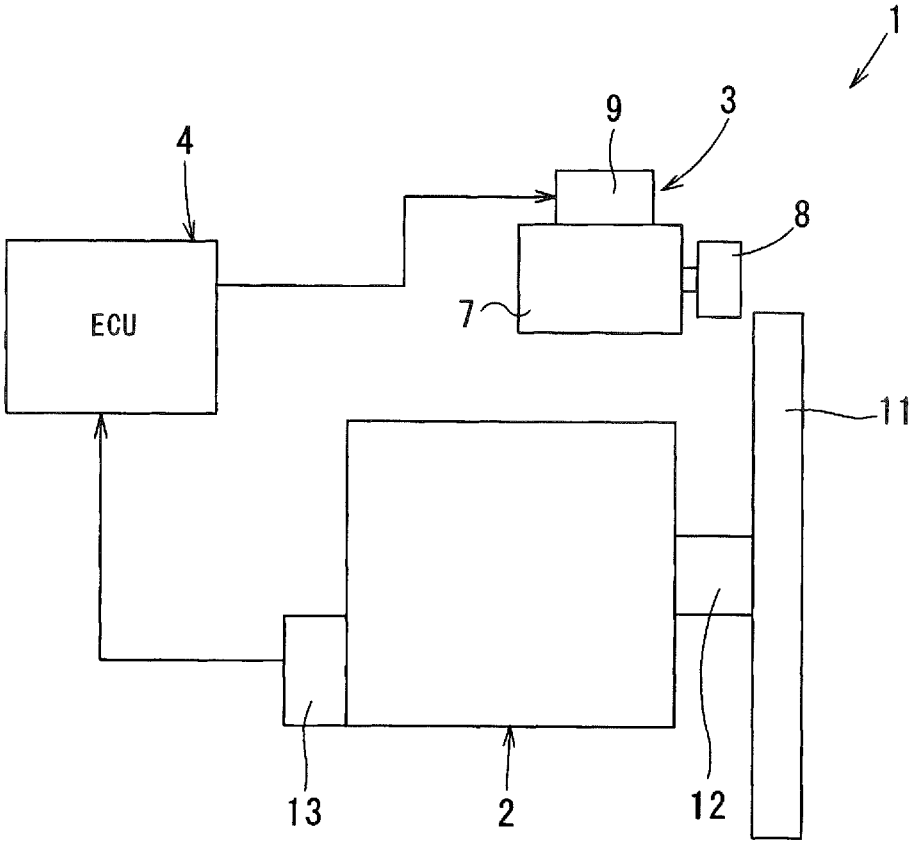
FIG. 1 is a schematic diagram of an engine starting apparatus in accordance with a first embodiment of the present invention.

The present invention will be described more fully hereinafter with reference to the accompanying drawings. Like numbers refer to like elements throughout.

First Embodiment

Configuration

There will now be explained a first embodiment of the present invention with reference to FIGS. 1-5.

An engine starting apparatus 1 of the first embodiment is adapted for a vehicle with an idle-stop system for automatically controlling stopping and restarting of an engine, and includes a starter 3 for starting the engine 2 and an electronic control unit (ECU) 4 configured to control operations of the starter 3.

The engine 2 of the present embodiment is a spark-ignited gasoline engine.

The starter 3 is an inertia-engagement-type starter capable of rotating up to speeds above an idle speed of the engine 2 and includes a motor 7, a pinion 8, an electromagnetic switch 9 and others.

The motor 7 is a direct-current (DC) commutator motor that includes a field (not shown) formed of permanent magnets (or field coils) disposed on an inner circumference of a yoke also serving as a frame, an armature having a commutator(not shown) disposed on an outer circumference of an armature axis, and brushes (not shown) disposed on an outer circumference of the commutator. The motor 7 is capable of rotating up to speeds above the idle speed.

The pinion 8, which is a small gear disposed on an output shaft of the motor 7, meshes with a ring gear 11 to transfer rotational force of the motor 7 to a crankshaft 12 of the engine 2 connected to the ring gear 11.

The electromagnetic switch 9 not only serves as pinion pushing means for pushing the pinion 8 toward the ring gear 11 via a shift lever (not shown) so that the pinion 8 is engaged with the ring gear 11, but also as a motor switch within an energization circuit for powering on and off the motor 7. In the electromagnetic switch 9, a solenoid for pushing the pinion 8 toward the ring gear 11 and a solenoid for turning on and off energization current of the motor 7 may be the same or distinct from each other.

The electronic control unit (ECU) 4 serves as a starter control unit configured to control energization of the starter 3 based on signals from an engine speed sensor 13 for detecting an engine speed, a start switch (not shown), a brake sensor (not shown) and the like.

The engine starting apparatus 1 is configured to operate the motor 7 with the pinion 8 engaged with the ring gear 11 to thereby crank the engine 2, and de-engage the pinion 8 from the ring gear 11 or de-energize the motor 7 to thereby terminate the cranking of the engine 2.

That is, upon command to start the engine 2, the ECU 4 puts the starter 3 in a drive ON state to crank the engine 2.

The drive ON state refers to a state such that the pinion 8 is in engagement with the ring gear 11 after being pushed toward the ring gear 11 and the motor 7 is in an energized state, and the rotational force of the motor 7 is thereby transferred to the crankshaft 12.

The command to start the engine 2 may be signaled to the ECU (starter control unit) 4 as a signal from the start switch that the start switch has been turned on while the engine 2 is stopped. In a vehicle with the idle-stop system mounted therein, the engine is restarted when idle stop (or idle shut down) is exited by deactivating the brake. Therefore, the command to start the engine 2 may also be signalled to the ECU (starter control unit) 4 as a detection signal from the brake sensor that the brake has been deactivated. The ECU 4 is also commanded to restart the engine 2 when the brake is deactivated during slowing to an automatic stop of the engine 2.

When a predetermined condition for terminating cranking of the engine is met, the ECU 4 returns the pinion 8 from the engaged position back into the original position to thereby de-energize the pinion 8 from the ring gear 11 or de-energize the motor 7 to thereby terminate cracking of the engine 2, that is, to thereby power off the starter.

Process of Controlling the Starter

In the present embodiment, a cranking time Ta from when cranking of the engine 2 is initiated to when an engine speed N1 is reached (hereinafter referred to as a time to engine speed N1) is equal to or less than a predefined amount of time as an acceptable limit of cranking time that does not provide noticeable discomfort to a user (or occupants) of the vehicle.

The engine speed N1 is a predetermined engine speed equal to or greater than 450 rpm. At an engine speed of 450 rpm or more, the engine 2 is auto-ignitable and rotation of the engine 2 can be maintained without increasing the injection quantity.

Figure 12:
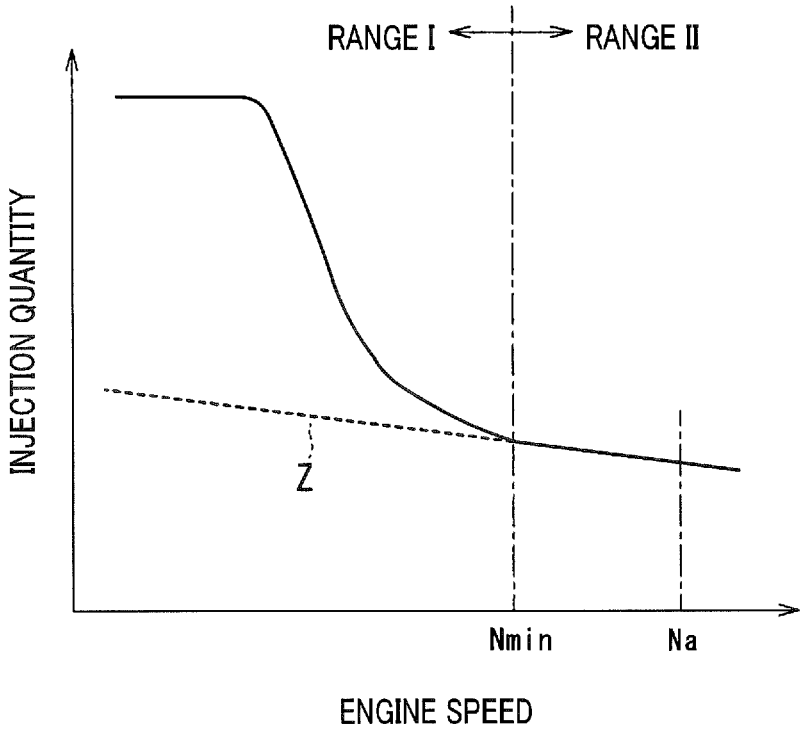
FIG. 12 is a correlation between an engine speed and a fuel injection quantity.

As shown in FIG. 12, a required fuel injection quantity at and near the idle speed Na of the engine is specified by the predetermined relationship Z of the engine speed and the fuel injection quantity while, below the predetermined engine speed Nmin, the required fuel injection quantity non-lineally increases away from the relationship Z as the engine speed is decreased.

At an engine speed within the range II that is equal to or greater than the engine speed Nmin, rotation of the engine 2 can be maintained without increasing the injection quantity.

The engine speed N1 is a predetermined engine speed equal to or greater than the engine speed Nmin that is a minimum engine speed within the range II.

In the present embodiment, the engine speed Nmin is equal to or less than the idle speed, for example, approximately 450 rpm. The engine speed N1 is a predetermined engine speed equal to or less than the idle speed and equal to or greater than 450 rpm. After the engine speed N1 is reached, the engine speed is increased via ignition. At an engine speed of 500 rpm or more, an engine speed equal to or greater than an engine resonance point can be reached within the range II where the injection quantity does not have to be increased.

The time to engine speed N1 Ta is equal to or less than a predefined amount of time as an acceptable limit of cranking time that does not provide noticeable discomfort due to cranking noise that continues until the engine speed N1 is reached to a user (or occupants) of the vehicle.

The inventors have found that discomfort due to cranking noise depends on a duration of cranking noise, that is, the time to engine speed N1 Ta. A too long time to engine speed N1 Ta may cause discomfort due to cranking noise to the user of the vehicle. Therefore, in the present embodiment, the time to engine speed N1 Ta is set to a short time that does not provide noticeable discomfort due to cranking noise to the user of the vehicle.

Figure 4:
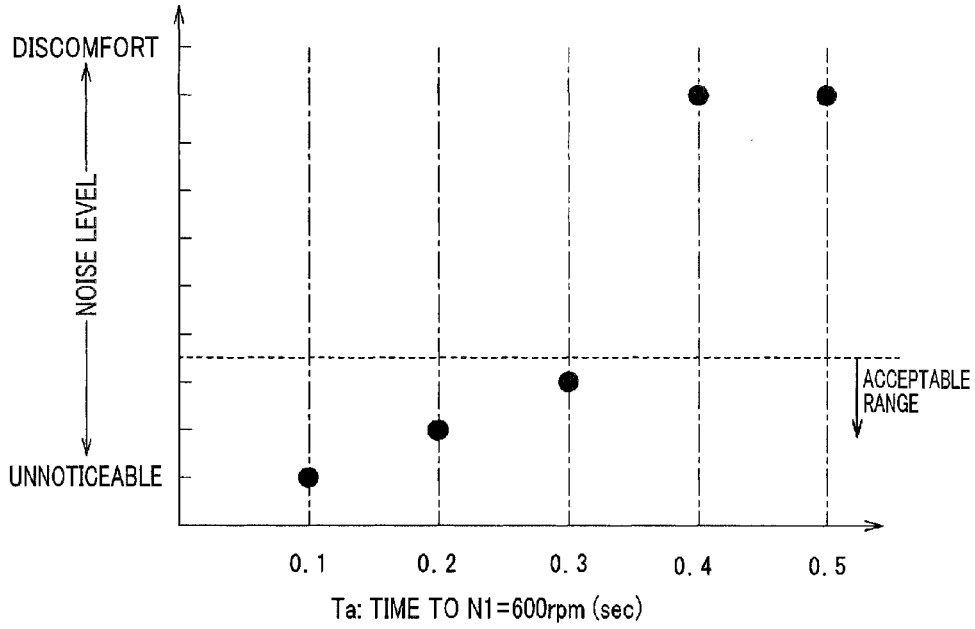
FIG. 4 is a correlation of noise level and cranking time, where cranking of the engine is initiated while the engine is stopped and the engine speed N1 is set at 600 rpm.

FIG. 4 shows an example of evaluation of degrees of discomfort (as noise levels) caused by the cranking noise for different cranking times, where cranking of the engine is initiated while the engine is stopped and the engine speed N1 is set at 600 rpm. The data is plotted with the time to engine speed N1 Ta as the abscissa and the noise level as the ordinate.

As can be seen from FIG. 4 where the engine speed N1 is set at 600 rpm, with a time to engine speed N1 Ta of 0.3 seconds or less, the cranking noise can cause almost unnoticeable discomfort to the user of the vehicle. With a time to engine speed N1 Ta of 0.4 seconds or more, the cranking noise can cause noticeable discomfort to the user of the vehicle.

Therefore, in this case, an acceptable limit of cranking time (from when cranking of the engine is initiated to when the engine speed N1 (600 rpm) is reached) that does not provide noticeable discomfort due to cranking noise may be set at 0.3 seconds.

The acceptable limit of cranking time depends on the engine speed N1, that is, the acceptable limit of cranking time decreases with increasing engine speed N1. For example, when the engine speed N1 is the idle speed that is greater than 600 rpm (about 700 rpm), the acceptable limit is about 0.2 seconds. That is, within a time period from when cranking of the engine is initiated to when the engine speed N1 (600 rpm) is reached, the cranking noise cannot cause noticeable discomfort to the user of the vehicle. When the engine speed is further increased to reach 700 rpm, the cranking noise can cause noticeable discomfort to the user of the vehicle because the cranking time exceeds the acceptable limit of 0.2 seconds for the engine speed N1=700 rpm.

In the present embodiment, the engine speed N1 is set at 600 rpm and the acceptable limit is set at 0.3 seconds, where the engine speed N (600 rpm) is to be reached within 0.3 seconds from when cranking of the engine is initiated.

More specifically, in an initial condition of the motor 7, the motor 7 is used with performance such that the engine speed N1 (600 rpm) can be reached within 0.2 seconds from when cranking of the engine is initiated. The initial condition is such that the battery is fully charged and drops of applied voltage to the motor 7 due to time degradation (including increase in resistance due to degradation of wirings) have not occurred.

The time to engine speed N1 Ta varies with a change in applied voltage to the motor 7 caused by the remaining charge in the battery and interconnection resistance.

Therefore, in the present embodiment, an initial value Ta0 of time to engine speed N1 Ta, which is the time to engine speed N1 Ta in the initial condition, is set at 0.2 seconds.

This initial value Ta0 is less than the acceptable limit of 0.3 seconds by a margin. With this margin, even when reduction in the remaining charge in the battery or time degradation causes applied voltage drop to the motor 7 and the time to engine speed N1 Ta thereby becomes greater than the initial value Ta0, the time to engine speed N1 Ta will remain below the acceptable limit (0.3 seconds). Therefore, preferably, the initial value Ta0 may be set such that the time to engine speed N1 Ta can remain below the acceptable limit even when reduction in the remaining charge in the battery or time degradation causes the applied voltage drop to the motor 7 and the time to engine speed N1 Ta therefore becomes greater than the initial value Ta0.

For example, in the initial condition of the starter 3, it takes 0.2 seconds (being an initial value of Ta) for the engine speed to reach 600 rpm while, in a condition where the applied voltage to the motor 7 is lowered to within a predetermined range (hereinafter referred to as a deterioration condition), it takes 0.3 seconds for the engine speed to reach 600 rpm.

Figure 5:
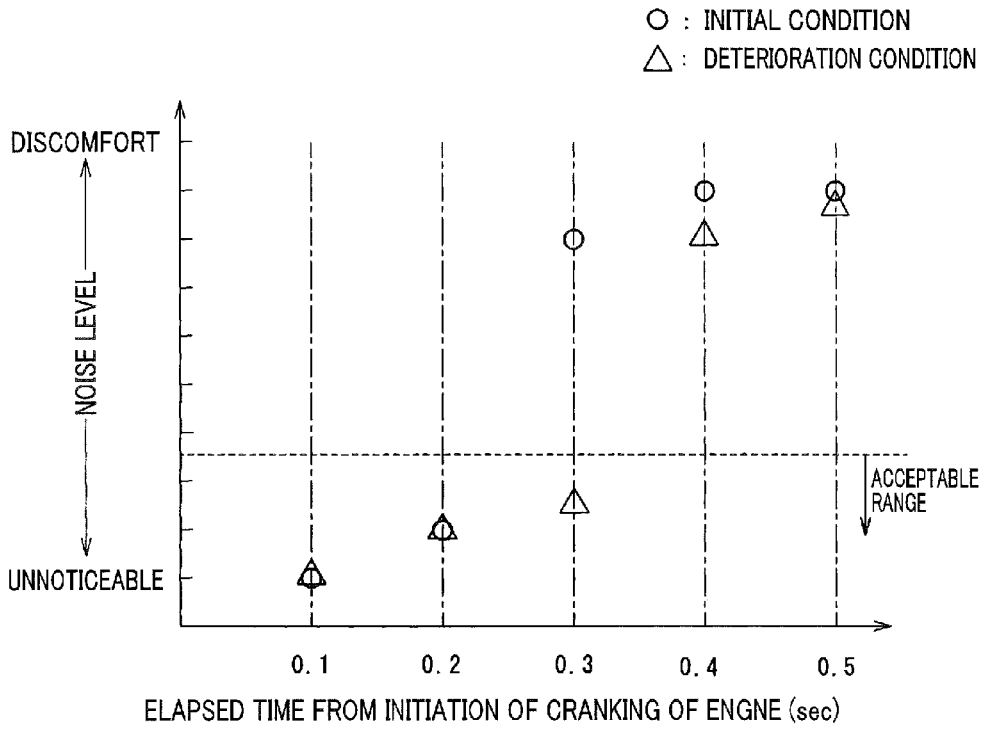
FIG. 5 is a correlation of noise level and cranking time before and after drop of applied voltage to a motor, in accordance with the first embodiment.

FIG. 5 shows a correlation of noise level and cranking time in each of the initial condition and the deteriorating condition, where a maximum engine speed MAX is reached by cranking the engine 2. The engine speed increases with increasing cranking time. In the initial condition of the starter 3, the engine speed reaches 600 rpm in 0.2 seconds and 700 rpm in 0.3 seconds. In the deterioration condition of the starter 3, the engine speed reaches 600 rpm not in 0.2 seconds, but in 0.3 seconds.

As shown in FIG. 5, in the initial condition, the noise level worsens after the cranking time exceeds 0.2 seconds. In the deterioration condition, the engine speed reaches 600 rpm in 0.3 seconds. Therefore, the noise level is within the acceptable range until the cranking time exceeds 0.3 seconds.

In the present embodiment, the termination of cranking of the engine 2 is followed by the ignition in the combustion chamber of the engine 2. For the spark-ignited engines, the ignition is initiated on or immediately after spark ignition. For the compression ignition engines, the ignition is initiated on or immediately after the fuel injection. In the present embodiment, the cranking of the engine 2 is terminated before the spark ignition.

A process of controlling the starter 3 will now be explained in more detail with reference to FIGS. 2 and 3.

Figure 2:
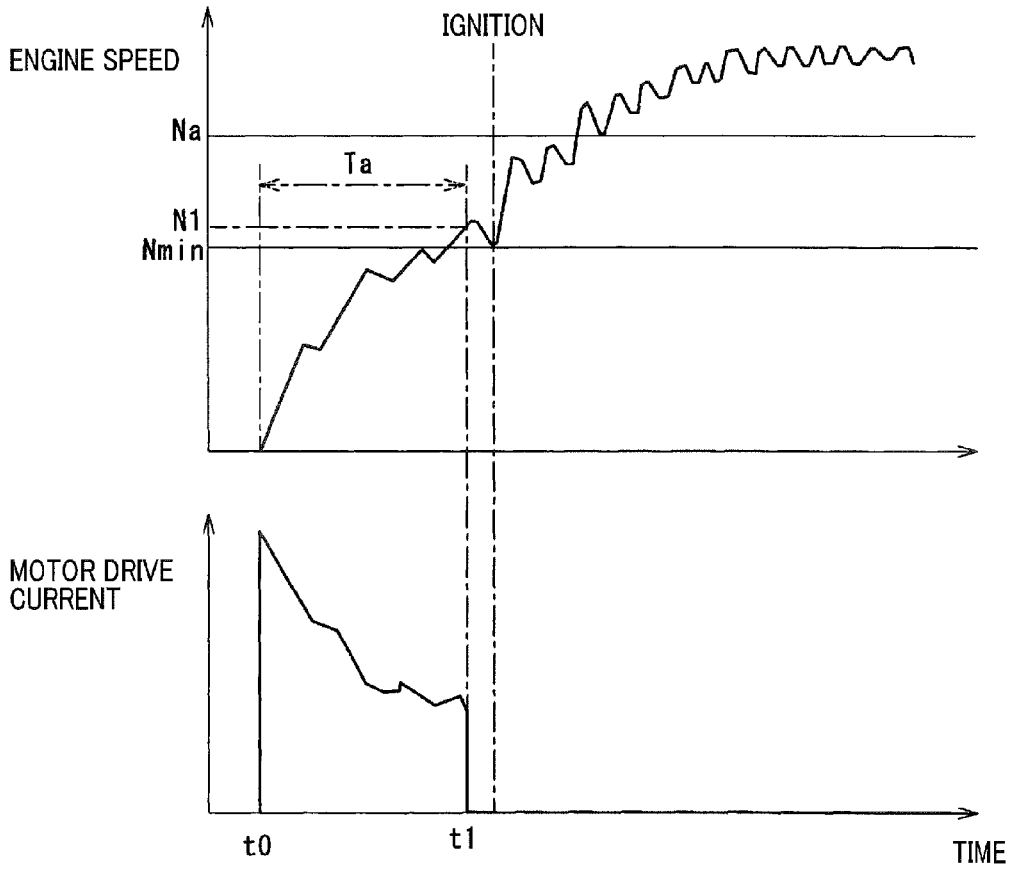
FIG. 2 is a schematic timing diagram of an engine speed and a motor drive current, in accordance with the first embodiment.
Figure 3:
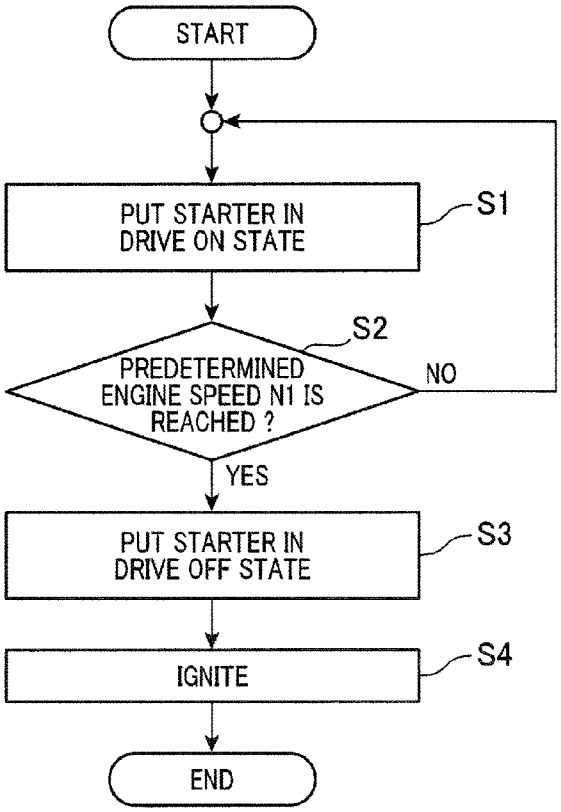
FIG. 3 is a flowchart of a process of controlling a starter in accordance with the first embodiment.

FIG. 2 shows a timing diagram for the process of controlling the starter 3 performed when the start command (signal) becomes ON while the engine 2 is stopped. Although not shown, a similar process of controlling the starter 3 may be performed upon command to restart the engine (or the start command becomes on) during slowing to an automatic stop of the engine 2.

First, in step S1, when the start switch is turned on or the brake is deactivated to exit the idle stop, the start command becomes ON and then the starter 3 is put in the drive ON state. That is, at time t0, the cranking of the engine 2 is initiated.

In the present embodiment, a condition for terminating the cranking of the engine 2 is that the engine speed N1 is reached. Therefore, the cranking of the engine 2 is terminated at time t1 when the engine speed N1 is reached.

In the present embodiment, the initial value Ta0 of time to engine speed N1 Ta is set at 0.2 seconds. Therefore, ideally, the engine speed reaches the engine speed N1 02 seconds after time t0.

That is, in step S2, it is determined whether or not the engine speed N1 is reached. If it is determined in step S2 that the engine speed N1 is reached, then in step S3, the starter 3 is put in the drive OFF state, thereby terminating the cranking of the engine 2.

During coasting of the engine 2 after the termination of cranking of the engine 2, the injected fuel is ignited by a spark plug in step S4. That is, the cranking of the engine 2 is terminated before the spark ignition. The fuel injection may be followed by the termination of the cranking of the engine 2, or preceded by the termination of cranking of the engine 2 and immediately after the ignition.

Advantages

With the engine starting apparatus 1 of the present embodiment, the cranking time Ta (i.e., the time to engine speed N1) from when cranking of the engine 2 is initiated to when the engine speed N1 is reached is equal to or less than the acceptable limit of cranking time that is a predetermined amount of time which does not provide noticeable discomfort to the user (or occupants) of the vehicle caused by cranking noise until the engine speed N1 is reached.

That is, in the present embodiment, the engine speed is increased to within the range II that is a high speed range of engine speeds equal to or greater than 450 rpm time within a cranking time short enough to provide unnoticeable discomfort to the user (or occupants) of the vehicle.

This can reduce the discomfort caused by the cranking noise that occurs during cranking of the engine 2 for increasing the engine speed to within the high speed range of engine speeds equal to or greater than 450 rpm. That is, the engine speed can be increased to within the high speed range of engine speeds equal to or greater than 450 rpm not by combustion, but by the starter 3, while mitigating the discomfort caused by the cranking noise.

The engine 2 undergoes the combustion after the engine speed is increased by the starter 3 to within the range II that is the high speed range of engine speeds equal to or greater than 450 rpm. This can reduce the fuel injection quantity, thereby improving the fuel economy.

In addition, in the present embodiment, the engine speed N1 is less than the idle speed. Cranking of the engine 2 is terminated before the idle speed is reached, and the termination of cranking of the engine 2 is followed by the spark ignition. Indeed, to reduce a fuel consumption, it is desirable that the cranking of the engine 2 is terminated after the engine speed is increased by the starter 3 to the idle speed and the termination of cranking of the engine 2 is followed by the spark ignition.

However, to crank the engine 2 until the idle speed is reached and without causing noticeable discomfort to the user (or occupants) of the vehicle, it is necessary to crank the engine 2 at a very high speed (e.g. such that the engine speed can reach 700 rpm in 0.2 seconds).

In the present embodiment, the engine speed N1 is less than the idle speed, but equal to or greater then 450 rpm. Therefore, even when the cranking of the engine 2 is terminated before the idle speed is reached, coasting of the engine 2 allows the engine speed to be increased to near the idle speed. This allows the engine 2 to undergo ignition while the engine speed is near the idle speed even without using a high performance motor.

Cranking of the engine 2 is thus terminated prior to the engine combustion, which can prevent a greater torque caused by the engine combustion from adversely affecting the pinion 8.

That is, in the present embodiment, a time period from when the cranking of the engine 2 is initiated to when the engine speed is increased to the idle speed or more may be divided into three periods. A first period is a cranking period from when the cranking of the engine 2 is initiated to when the engine speed N1 is reached. A second period is a coasting period from when the cranking of the engine 2 is terminated to when the engine speed is increased from the engine speed N1 to near the idle speed. The engine 2 rotationally coasts during the second period. A third period is a rotating period in which the engine speed is increased from near the idle speed to greater than the idle speed by ignition. In the first and second periods, the engine speed can be increased without increasing the injection quantity. This can reduce the discomfort caused by the cranking noise as compared with the case where the cranking of the engine 2 is continued during the first and second periods.

Thus, the engine starting apparatus can be provided that is capable of starting the engine via an inexpensive inertia-engagement-type starter while improving fuel economy.

Second Embodiment

Figure 6:
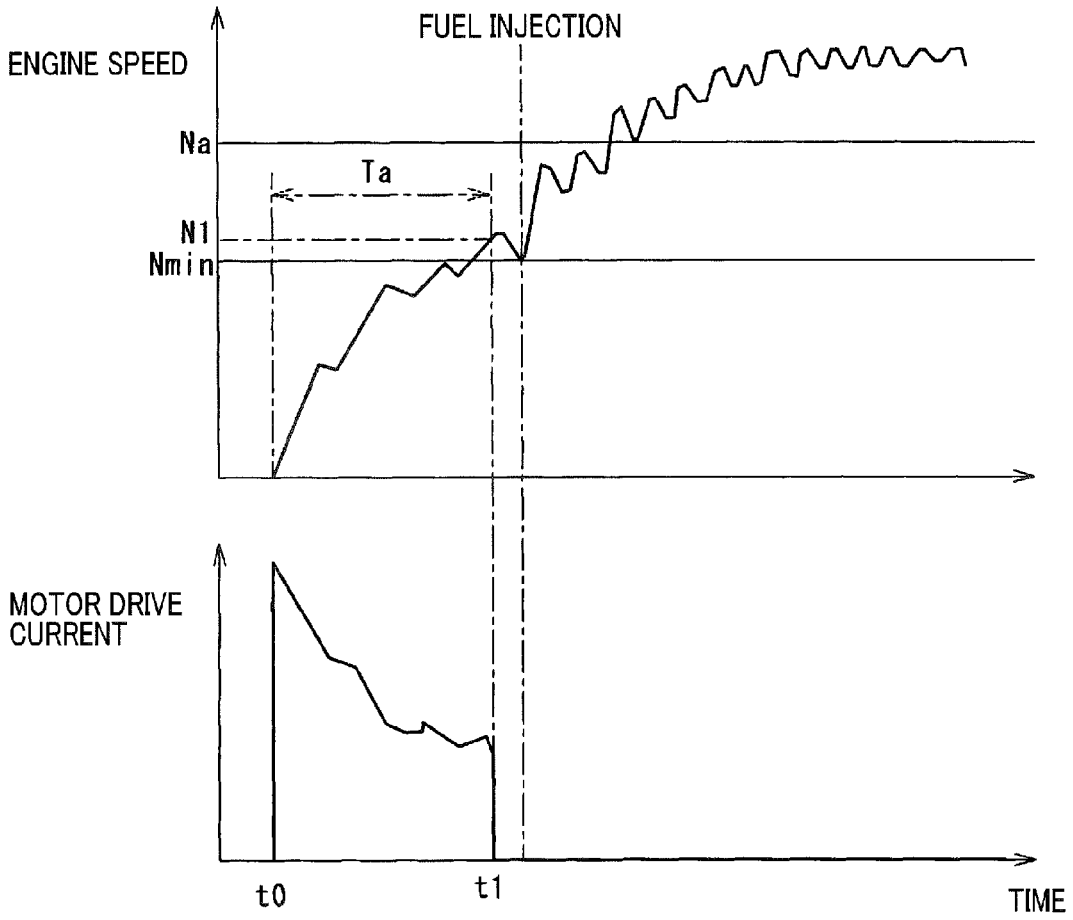
FIG. 6 is a schematic timing diagram of an engine speed and a motor drive current, in accordance with a second embodiment of the present invention.
Figure 7:
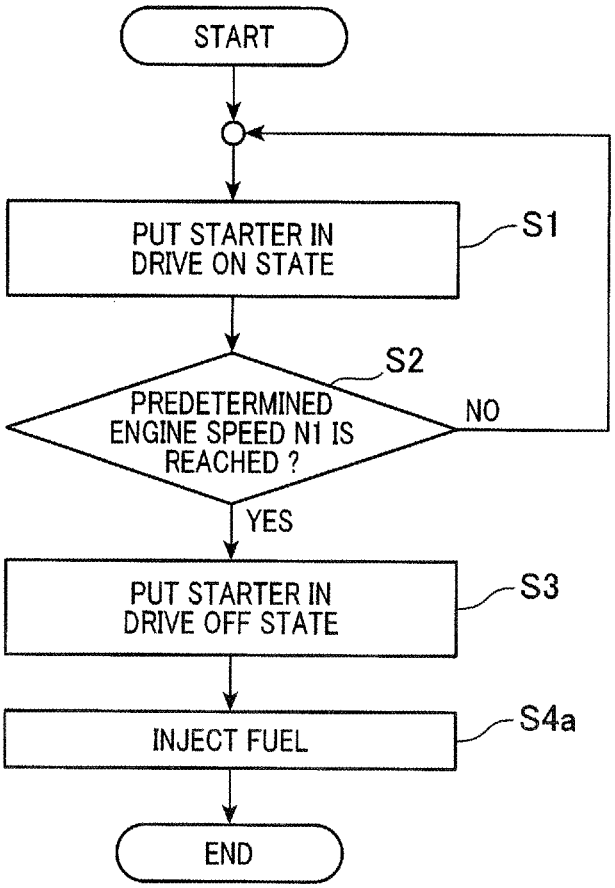
FIG. 7 is a flowchart of a process of controlling a starter in accordance with the second embodiment.

An engine starting apparatus 1 in accordance with a second embodiment of the present invention will now be explained with reference to FIGS. 6 and 7. Only differences of the second embodiment from the first embodiment will be explained. Elements having the same functions as in the first embodiment are assigned the same numbers and will not be described again for brevity.

In the present embodiment, the engine 2 is a compression ignition engine. Cranking of the engine 2 is terminated before fuel injection.

That is, in step S4*a*, fuel is injected into the combustion chamber of the engine 2 after the cranking of the engine 2 is terminated.

The second embodiment can provide similar advantages to those of the first embodiment.

Third Embodiment

Figure 8:
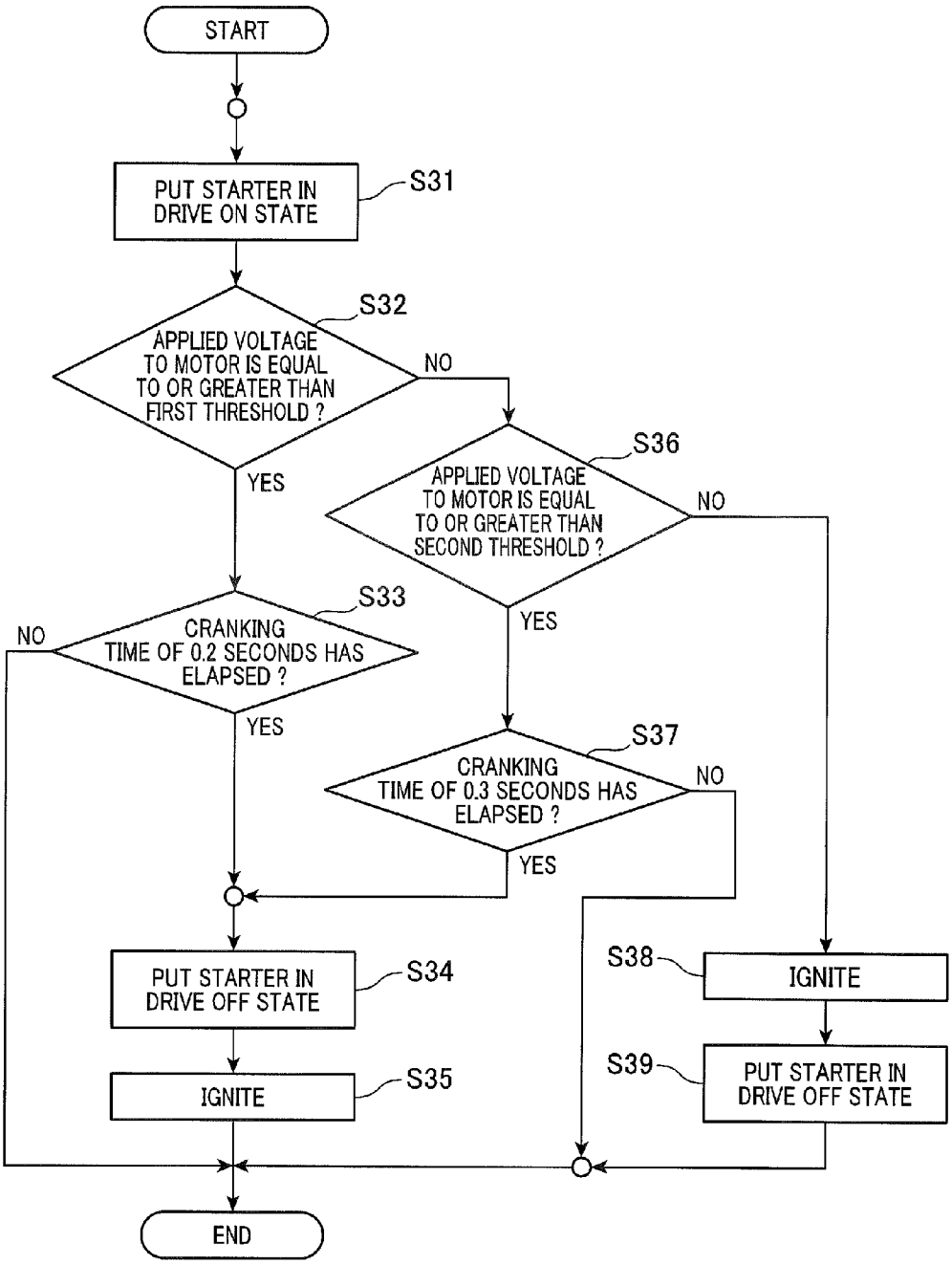
FIG. 8 is a flowchart of a process of controlling a starter in accordance with a third embodiment of the present invention.

An engine starting apparatus 1 in accordance with a third embodiment of the present invention will now be explained with reference to FIG. 8. Only differences of the third embodiment from the first embodiment will be explained.

Elements having the same functions as in the first embodiment are assigned the same numbers and will not be described again for brevity.

In the first embodiment, termination of cranking of the engine 2 is conditional upon the engine speed N1 being reached. That is, the cranking of the engine 2 is terminated at the time when the engine speed N1 is reached.

In the present embodiment, based on an amount of time that has elapsed from initiation of cranking of the engine 2, it is estimated whether or not the engine speed N1 has been reached.

However, as described above, the time to engine speed N1 Ta may become greater than the initial value Ta0 due to the applied voltage drop to the motor 7 caused by reduction in the remaining charge in the battery or time degradation. Hence, if the cranking of the engine 2 is terminated upon elapse of the initial value Ta0 without exception, the cranking of the engine 7 would be terminated while the engine speed is actually below the engine speed N1.

To overcome such a disadvantage, for example, the applied voltage to the motor 7 is monitored. A condition for terminating the cranking of the engine 2 is changed based on the monitored applied voltage. This process will now be explained with reference to FIG. 8.

In the initial condition of the starter 3 of the present embodiment, it takes 0.2 seconds (being an initial value Ta0 of time to engine speed N1 Ta) for the engine speed to reach 600 rpm while, in a deterioration condition where the applied voltage to the motor 7 has dropped to within the predetermined range, it takes 0.3 seconds for the engine speed to reach 600 rpm.

First, in step S31, when the start switch is turned on or the brake is deactivated to exit the idle stop, the start command becomes ON and then the starter 3 is put in the drive ON state. That is, the cranking of the engine 2 is initiated.

Subsequently, in step S32, it is determined whether or not the applied voltage to the motor 7 is equal to or greater than a first threshold. If it is determined that the applied voltage to the motor 7 is equal to or greater than the first threshold, then the process proceeds to step S33. In step S33, it is determined whether or not a cranking time of 0.2 seconds (being the initial value Ta0) has elapsed from the initiation of cranking of the engine 2. If the cranking time of 0.2 seconds has elapsed from the initiation of cranking of the engine 2, then it is assumed that the engine speed N1 has been reached and the starter 3 is put in the drive OFF state in step S34. Thereafter, the engine 2 undergoes the ignition in step S35.

If it is determined in step 32 that the applied voltage to the motor 7 is less than the first threshold, then in step S36, it is determined whether or not the applied voltage to the motor 7 is equal to or greater than a second threshold. If it is determined that the applied voltage to the motor 7 is equal to or greater than the second threshold, then the process proceeds to step S37. In step S37, it is determined whether or not a cranking time of 0.3 seconds has elapsed from the initiation of cranking of the engine 2. If the cranking time of 0.3 seconds has elapsed from the initiation of cranking of the engine 2, then it is assumed that the engine speed N1 has been reached and the starter 3 is put in the drive OFF state in step S34. Thereafter, the engine 2 undergoes the ignition in step S35.

If it is determined in step S36 that the applied voltage to the motor 7 is less than the second threshold, then it is assumed that the engine speed N1 cannot be reached in a short cranking time and the process proceeds to step S38. In step S38, the engine 2 undergoes the ignition a predetermined amount of time after the initiation of cranking of the engine 2 whether or not the engine speed N1 has been reached. Thereafter, the cranking of the engine 2 is terminated in step S39.

In the present embodiment, when it is estimated whether or not the engine speed N1 has been reached based on an amount of time elapsed since the initiation of cranking of the engine, a level of applied voltage drop to the motor 7 due to reduction in the remaining charge in the battery or time degradation is determined and taken into account. This allows whether or not the engine speed N1 has been reached to be accurately estimated based on the amount of time elapsed since the initiation of cranking of the engine.

In addition, in the present embodiment, when the level of applied voltage drop to the motor 7 is within a predetermined acceptable range, the termination of cranking of the engine is followed by the ignition in the combustion chamber of the engine. When the level of applied voltage drop to the motor 7 is out of the predetermined acceptable range, the termination of cranking of the engine is preceded by the ignition in the combustion chamber of the engine.

That is, in the present embodiment, when the applied voltage to the motor 7 is less than the second threshold, it is assumed that the engine speed N1 cannot be reached in a short cranking time. In this case, the engine undergoes the ignition a predetermined amount of time after the initiation of cranking of the engine whether or not the engine speed N1 has been reached. Thereafter, the cranking of the engine 2 is terminated. This can reliably produce ignition secure even when the applied voltage to the motor 7 has dropped so much that the engine speed cannot be increased to N1 in a short cranking time.

The level of applied voltage drop to the motor 7 due to reduction in the remaining charge in the battery or time degradation may be determined by directly monitoring the applied voltage to the motor 7 as in the present embodiment or alternatively by monitoring the remaining charge in the battery.

Fourth Embodiment

An engine starting apparatus 1 in accordance with a fourth embodiment of the present invention will now be explained with reference to FIGS. 9-11. Only differences of the fourth embodiment from the first embodiment will be explained. Elements having the same functions as in the first embodiment are assigned the same numbers and will not be described again for brevity.

In the electromagnetic switch 9 (serving as a motor energization unit and a pinion pushing unit) of the present embodiment, a solenoid SL1 for pushing the pinion 8 toward the ring gear 11 (SL1 corresponding to the pinion pushing unit) and a solenoid SL2 for turning on and off energization current of the motor 7 (SL2 corresponding to the motor energization unit) are distinct from each other. Therefore, the motor 7 may be controlled such that the energization current of the motor 7 can be turning on and off independently of pushing the pinion 8 toward the ring gear 11.

Figure 9:
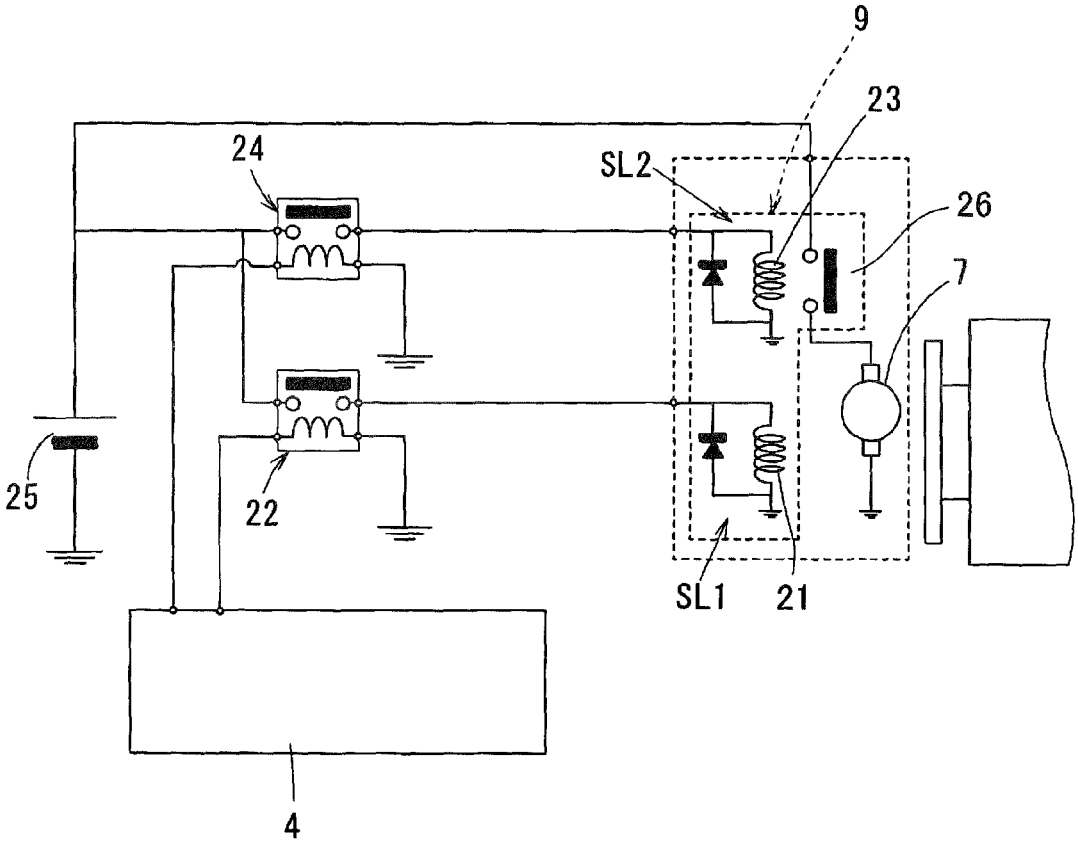
FIG. 9 is an electrical circuit diagram of an engine starting apparatus in accordance with a fourth embodiment of the present invention.

FIG. 9 shows a circuit diagram of an engine starting apparatus 1 including the solenoid SL1 and the solenoid SL2.

A coil 21 of the solenoids SL1 is electrically connected to the drive relay 22 and a coil 23 of the solenoids SL2 is electrically connected to the drive relay 24. The drive relays 22, 24 separately operate in response to signals from the ECU 4.

When the drive relay 22 is switched ON, the coil 21 is energized by the current flowing from a battery 25 to the coil 22 through the drive relay 22 (where the solenoid SL1 is ON) and the pinion 8 is thereby pushed toward the ring gear 11 to mesh with the ring gear 11. When the drive relay 22 is switched OFF, the coil 21 is de-energized (where the solenoid SL1 is OFF) and the pinion 8 returns back to the original position.

When the drive relay 24 is switched ON, the coil 23 is energized by the current flowing from the battery 25 to the coil 23 through the drive relay 24 (where the solenoid SL2 is ON) and a main contact 26 provided in the energization circuit from the battery 25 to the motor 7 is thereby closed. This allows the motor 7 to be energized. When the drive relay 24 is switched OFF, the coil 23 is de-energized (where the solenoid SL2 is OFF) and the main contact 26 is thereby opened. This allows the motor 7 to be de-energized.

In the present embodiment, the motor 7 is de-energized upon termination of cranking of the engine. After achievement of self-ignition of the engine 2, driving of the starter 3 is controlled to de-engage the pinion 8 from the ring gear 11.

Figure 10:
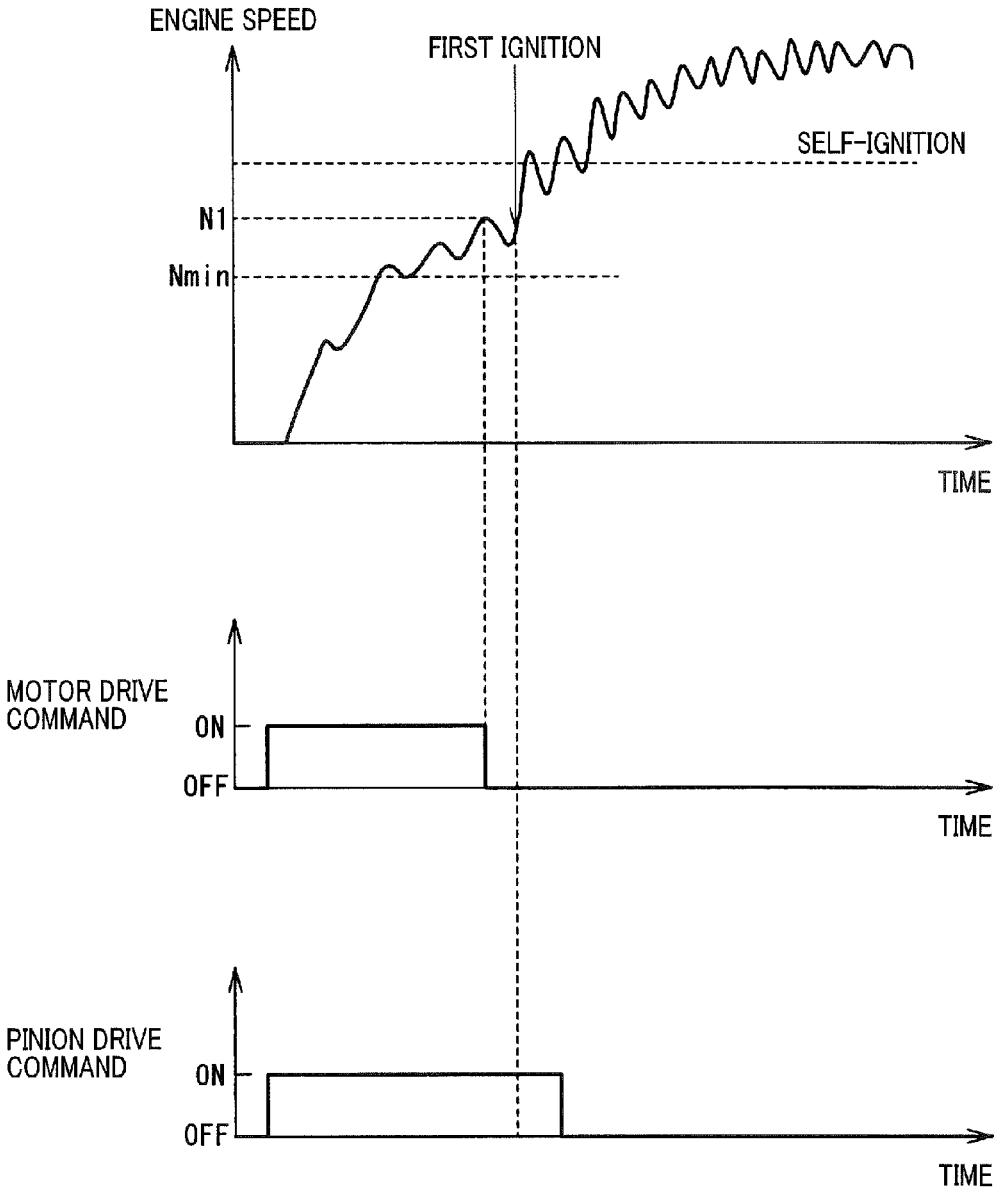
FIG. 10 is a schematic timing diagram of an engine speed, a motor drive command, a pinion drive command in accordance with the fourth embodiment.

As shown in FIG. 10, when the engine speed N1 is reached, a motor drive command is set OFF. That is, the solenoid SL2 is powered OFF and the motor 7 is thereby de-energized so that the cranking of the engine is terminated. Thereafter, the engine is ignited, the first ignition occurs, and the self-ignition is achieved. After achievement of the self-ignition, a pinion drive command is set OFF. That is, the solenoid SL1 is powered OFF and the pinion 8 is thereby de-engaged from the ring gear 11.

Figure 11:
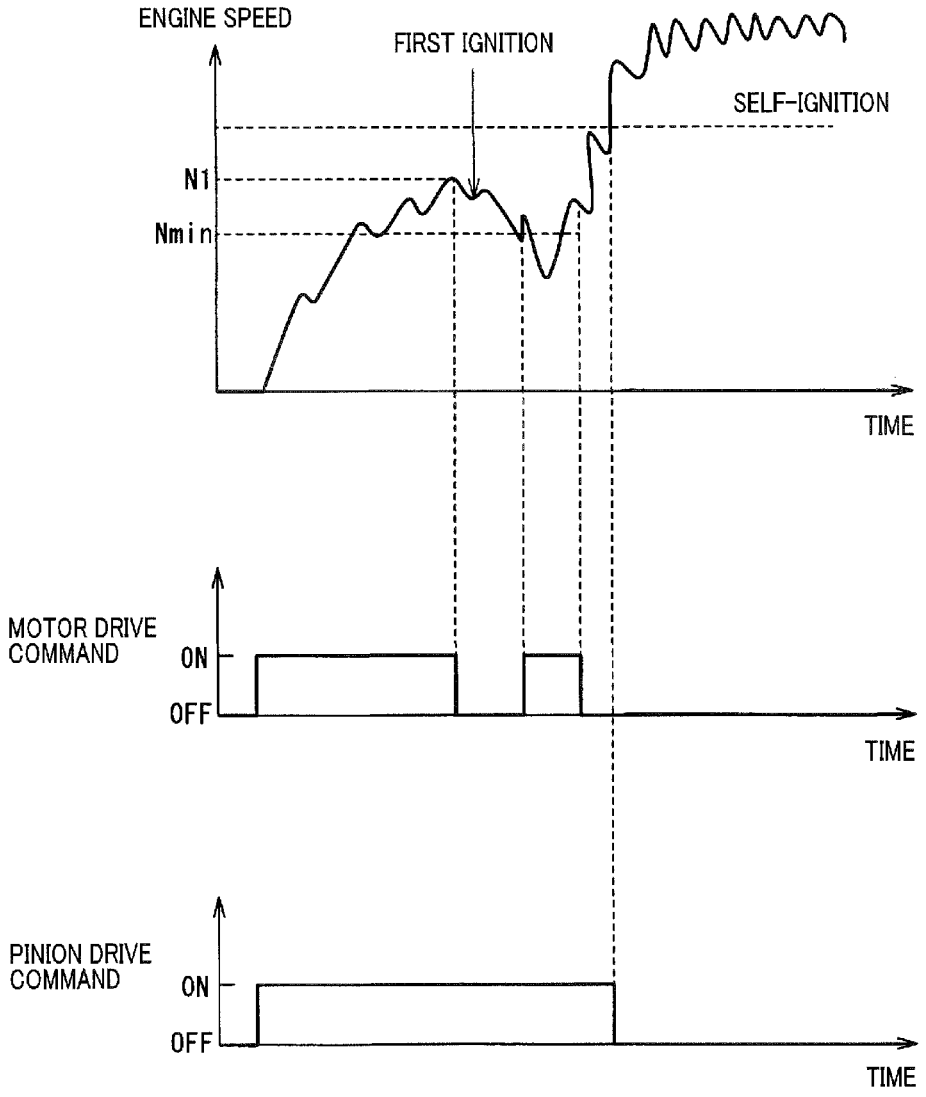
FIG. 11 is a schematic timing diagram of an engine speed, a motor drive command, a pinion drive command in accordance with the fourth embodiment.

As shown in FIG. 11, when the first ignition does not occur after the motor 7 is de-energized and then ignited, driving of the starter is controlled such that the motor 7 is energized to crank the engine again.

For example, when an engine speed less than the engine speed N1 is continuously detected after the time to engine speed N1 Ta has elapsed, it is determined that the first ignition has failed. In such a case, the motor 7 is energized again to crank the engine so that the engine speed becomes equal to or greater than Nmin. Thereafter, the engine is ignited again. After achievement of the self-ignition, the pinion drive command is set OFF.

Whether or not the self-ignition has been achieved may be determined by determining whether or not the engine speed has reached an engine speed that allows for assuming that the self-ignition has been achieved.

Even when the first ignition has failed, this allows the engine to be started quickly by being cranked again.

Modifications

In the first embodiment, the termination of cranking of the engine 2 is followed by the ignition. Alternatively, when the ignition occurs in the combustion chamber of the engine is predicted based on the engine speed or the like. The cranking of the engine 2 may be terminated prior to the predicted time of ignition. Still alternatively, the cranking of the engine 2 may be terminated before at least one of the first ignition and the self-ignition.

In addition, in some alternative embodiments, the cranking of the engine may be continued even after the first ignition occurs. For example, the engine speed is increased to the idle speed within a cranking time of 0.2 seconds, the engine is ignited, and then the cranking of the engine may be terminated after the first ignition has occurred. Such an embodiment can provide an advantage that the time to engine speed N1 Ta can be reduced, that is, the discomfort caused by the cranking noise generated during a time period from when the cranking of the engine is initiated to when the engine speed N1 (the idle speed in this case) is reached can be mitigated.

In the first embodiment, after the engine speed is increased to the predetermined engine speed N1 equal to or greater than 450 rpm in the cranking time Ta that is equal to or less than the acceptable limit, the cranking of the engine is terminated before the ignition (see FIG. 2). Alternatively, the cranking time Ta may exceed the acceptable limit. that is, whether the cranking time Ta is greater or less than the acceptable limit, the engine speed may be increased to the predetermined engine speed N1 equal to or greater than 450 rpm in the cranking time Ta and then the cranking of the engine may be terminated before the first ignition occurs.

Also in such alternative embodiments, the cranking time may be reduced as compared with embodiments where the cranking of the engine is continued even after the first ignition. This can mitigate the discomfort caused by the cranking noise.

Since the engine speed is increased, by cranking the engine, to the predetermined engine speed N1 equal to or greater than 450 rpm, coasting of the engine allows the engine speed to be increased (to near the idle speed) for a short time even after the cranking of the engine is terminated. Therefore, even when the cranking of the engine is terminated before the first ignition occurs, the first ignition is less likely to fail in a high speed range of engine speed (the range II). However, although the first ignition is less likely to fail, it is desirable to, in case, apply the control of the electromagnetic switch 9 as described in the fourth embodiment.

Alternatively, the starter 3 may not include the one-way clutch (not shown) not only for transferring the rotational force of the motor 7 to the pinion 8, but also for isolating the transfer of rotational force from the pinion 8 to the motor 7. This is because, in the above embodiments, the cranking of the engine is terminated prior to the engine combustion and the motor therefore is unlikely to be turned by the engine.

In some embodiments where the cranking of the engine is terminated after the engine combustion, the starter 3 may include the one-way clutch.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An engine starting apparatus comprising:

a starter including a motor that generates rotational force, a pinion that receives the rotational force of the motor to rotate, a motor energization unit that turns on and off power supply from a battery to the motor, and a pinion pushing unit that pushes the pinion toward a ring gear of an engine to mesh with the ring gear; and a starter control unit configured to control driving of the starter, the starter control unit being configured to operate the motor with the pinion engaged with the ring gear to thereby crank the engine, and de-engage the pinion from the ring gear or de-energize the motor to thereby terminate the cranking of the engine, wherein a cranking time from when cranking of the engine is initiated to when a predetermined engine speed equal to or greater than 450 rpm is reached is equal to or less than an acceptable limit of cranking time that does not provide, to a user of a vehicle, noticeable discomfort caused by cranking noise generated during the cranking of the engine.

2. The apparatus of claim 1, wherein the cranking time is equal to or less than 0.3 seconds.

3. The apparatus of claim 1, wherein the predetermined engine speed is equal to or greater than 500 rpm.

4. The apparatus of claim 1, wherein the predetermined engine speed of the engine is equal to or less than an idle speed, and the starter control unit is further configured such that the termination of cranking of the engine is before the idle speed of the engine is reached.

5. The apparatus of claim 1, wherein the starter control unit is further configured such that the termination of cranking of the engine is before ignition in a combustion chamber of the engine.

6. The apparatus of claim 5, wherein actuation of the motor energization unit of the starter and actuation of the pinion pushing unit of the starter are individually controllable by the starter control unit, and the starter control unit is further configured to control driving of the starter such that the motor is de-energized when terminating the cranking of the engine by controlling the motor energization unit and the pinion is de-engaged from the ring gear by controlling the pinion pushing unit after achievement of self-ignition of the engine.

7. The apparatus of claim 1, wherein the engine is a spark-ignited engine, and the starter control unit is further configured such that the termination of cranking of the engine is before spark ignition in a combustion chamber of the engine.

8. The apparatus of claim 1, wherein the engine is a compression ignition engine, and the starter control unit is further configured such that the termination of cranking of the engine is before fuel injection into a combustion chamber of the engine.

9. The apparatus of claim 1, wherein the starter control unit is further configured to determine a level of applied voltage drop to the motor due to reduction in the remaining charge in the battery or time degradation, and the starter control unit is further configured such that, when the level of applied voltage drop to the motor is within a predetermined acceptable range, the termination of cranking of the engine is before ignition in a combustion chamber of the engine, and when the level of applied voltage drop to the motor is out of the predetermined acceptable range, the termination of cranking of the engine is after the ignition in the combustion chamber of the engine.

10. The apparatus of claim 6, wherein the starter control unit is further configured to control driving of the starter such that, when first ignition has failed after the termination of cranking of the engine, the motor is energized to crank the engine again by controlling the motor energization unit.

11. An engine starting apparatus comprising:

a starter including a motor that generates rotational force, a pinion that receives the rotational force of the motor to rotate, a motor energization unit that turn on and off power supply from a battery to the motor, and a pinion pushing unit for pushing the pinion to mesh with a ring gear of the engine; and a starter control unit configured to control driving of the starter, the starter control unit being configured to operate the motor with the pinion engaged with the ring gear to thereby crank the engine, and de-engage the pinion from the ring gear or de-energize the motor to thereby terminate the cranking of the engine, wherein the starter control unit configured to control driving of the starter such that the starter cranks the engine until an engine speed is increased to a predetermined engine speed equal to or greater than 450 rpm and terminates the cranking of the engine prior to first ignition of the engine.

12. The apparatus of claim 11, wherein actuation of the motor energization unit of the starter and actuation of the pinion pushing unit of the starter are individually controllable by the starter control unit, and the starter control unit is further configured to control driving of the starter such that the motor is de-energized when terminating the cranking of the engine by controlling the motor energization unit and the pinion is de-engaged from the ring gear by controlling the pinion pushing unit after achievement of self-ignition of the engine.

13. The apparatus of claim 12, wherein the starter control unit is further configured to control driving of the starter such that, when first ignition has failed after the termination of cranking of the engine, the motor is energized to crank the engine again by controlling the motor energization unit.

* * * * *